US006595225B2

(12) United States Patent
Chuang et al.

(10) Patent No.: US 6,595,225 B2
(45) Date of Patent: Jul. 22, 2003

(54) PULL ROD STRUCTURE OF SELF-OPENING UMBRELLA

(76) Inventors: Wen-Chieh Chuang, No. 103, Sec. 1, Hsin Chiung Rd., Hsin Pu Jen, Hsin Chu Hsien (TW); Chun I Chuang, No. 103, Sec. 1, Hsin Chiung Rd., Hsin Pu Jen, Hsin Chu Hsien (TW)

( * ) Notice: Subject to any disclaimer, the term of this patent is extended or adjusted under 35 U.S.C. 154(b) by 25 days.

(21) Appl. No.: 09/928,692

(22) Filed: Aug. 14, 2001

(65) Prior Publication Data

US 2003/0034059 A1 Feb. 20, 2003

(51) Int. Cl.[7] ..... A45B 25/14; A45B 25/16

(52) U.S. Cl. ..... 135/31; 135/29; 135/22; 135/32

(58) Field of Search ..... 135/22, 23, 28, 135/29, 30, 31, 32

(56) References Cited

U.S. PATENT DOCUMENTS 722,229 A * 3/1903 Gurney
850,445 A * 4/1907 Beam
938,950 A * 2/1909 Beecher
2,621,669 A * 12/1952 Mayer
2,705,967 A * 4/1955 Zimmermann et al.
3,177,882 A * 4/1965 Militano
3,177,883 A * 4/1965 Militano
3,252,468 A * 5/1966 Militano
4,821,756 A * 4/1989 England
6,158,452 A * 12/2000 You
6,196,244 B1 * 3/2001 Haddad et al.
6,345,637 B1 * 2/2002 Ko
6,397,866 B1 * 6/2002 You
6,397,867 B2 * 6/2002 You

* cited by examiner

*Primary Examiner*—Robert Canfield
(74) *Attorney, Agent, or Firm*—Rosenberg, Klein & Lee

(57) ABSTRACT

The present invention proposes an improved pull rod structure of a self-opening umbrella, wherein joints are disposed in stretchers. The joints are made of plastic material. The present invention is characterized in that each of the joints has a soft pull rod integrally formed therewith. The other end of each of the soft pull rods is installed in a lower nest. The joints are exploited to facilitate the assembly of a self-opening umbrella.

5 Claims, 5 Drawing Sheets

PULL ROD STRUCTURE OF SELF-OPENING UMBRELLA

FIELD OF THE INVENTION

The present invention relates to an improved pull rod structure of a self-opening umbrella and, more particularly, to stretchers having joints, which are made of plastic material and have soft pull rods integrally formed therewith.

BACKGROUND OF THE INVENTION

FIG. 1 shows an unfolded state of a prior art self-opening umbrella. As shown in this figure, a shaft 11*a* of a general self-opening umbrella 10*a* usually has an upper nest 12*a*, a middle nest 13*a*, and a lower nest 14*a* installed thereon. A spring 15*a* is sleeved on the portion of the shaft 11*a* between the middle nest 13*a* and the lower nest 14*a*. The middle nest 13*a* joins stretchers 16*a*. Each of the stretchers 16*a* has a pull rod 162*a* thereon. Two ends of each of the pull rods 162*a* are joined on one of the stretchers 16*a* and the lower nest 14*a*, respectively. The stretchers 16*a* and the pull rods 162*a* are joined together with hinges. For this kind of joining, each of the stretchers 16*a* needs to have a joint 161*a* sleeved into one of the pull rods 162*a*. A wire penetrates through shuttle holes 1621*a* of the pull rods 162*a* and is then locked onto the lower nest 14*a* to join the pull rods 162*a* and the lower nest 14*a* together. Because the joints 161*a* and the pull rods 162*a* are made of metallic material, it is very cumbersome to form holes and grooves on the joints 161*a* and the pull rods 162*a*, to achieve joining with hinges, and to install the joints 161*a* on the stretchers 16*a*. The assembly is also inconvenient. Moreover, if subassemblies need to be replaced, the disassembly is also very troublesome.

Accordingly, the assembly of the above self-opening umbrella is difficult, the manufacture of subassemblies is very cumbersome, and the disassembly is hard if subassemblies need to be replaced. In other words, the above self-opening umbrella has inconvenience and drawbacks in practical use. The present invention aims to resolve the above problems in the prior art.

SUMMARY OF THE INVENTION

The primary object of the present invention is to provide an improved pull rod structure of a self-opening umbrella to facilitate the assembly of the self-opening umbrella, and to simplify the manufacture of subassemblies thereof so that replacement of the subassemblies is very convenient.

To achieve the above object, the present invention provides an improved pull rod structure of a self-opening umbrella comprising joints made of plastic material and disposed on stretchers. Each of the joints has a soft pull rod integrally formed therewith. The other end of each of the soft pull rods has an installation end installed in a lower nest. Because the soft pull rods can be bent many times, they can substitute for a complicated pull rod structure in the prior art to simplify the assembly of a self-opening umbrella.

The various objects and advantages of the present invention will be more readily understood from the following detailed description when read in conjunction with the appended drawing, in which:

DETAILED DESCRIPTION OF THE PREFERRED EMBODIMENTS

Figure 1:
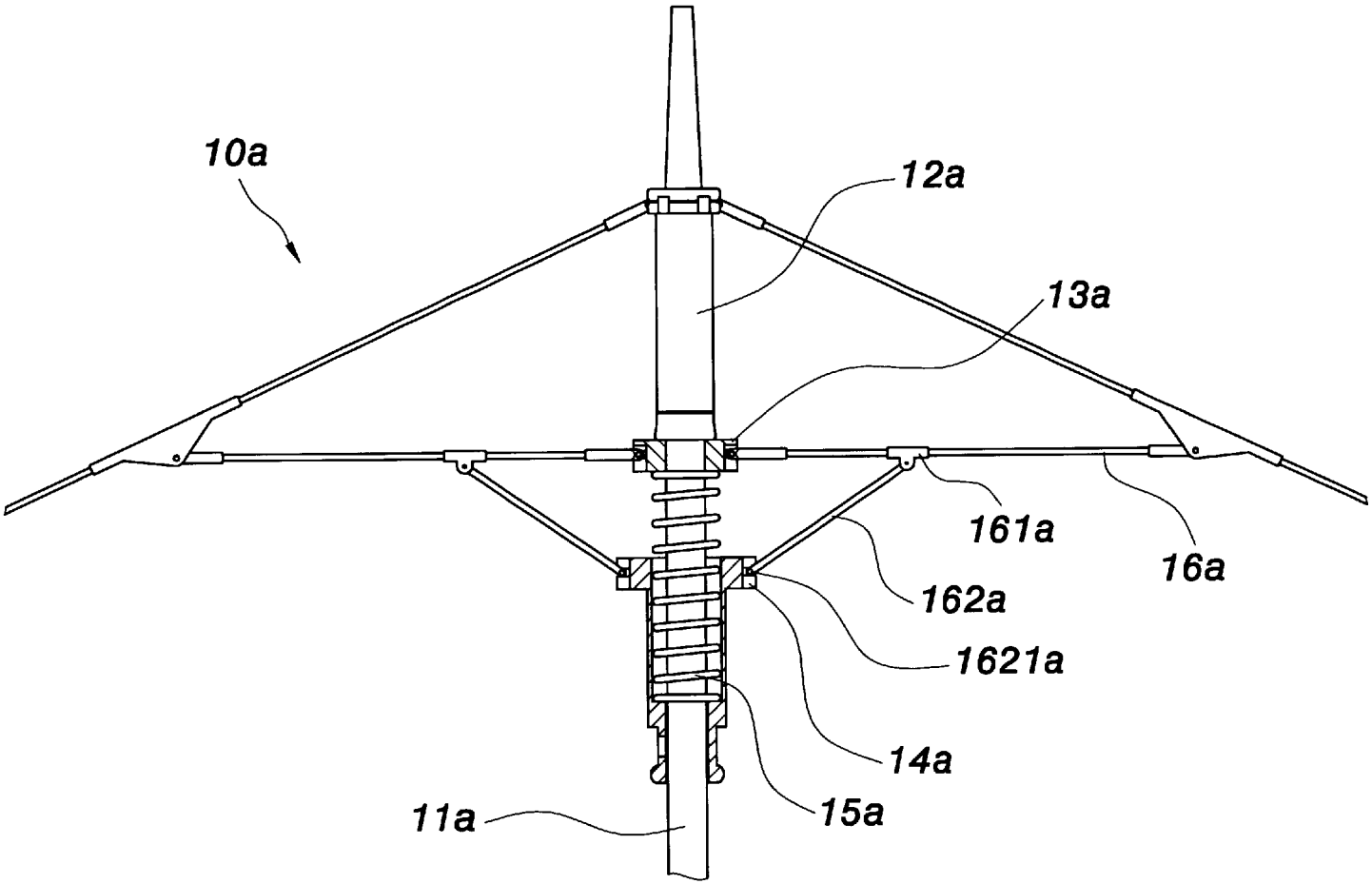
FIG. 1 PRIOR ART
FIG. 1 is a diagram of a pull rod structure of a prior art self-opening umbrella.
Figure 2:
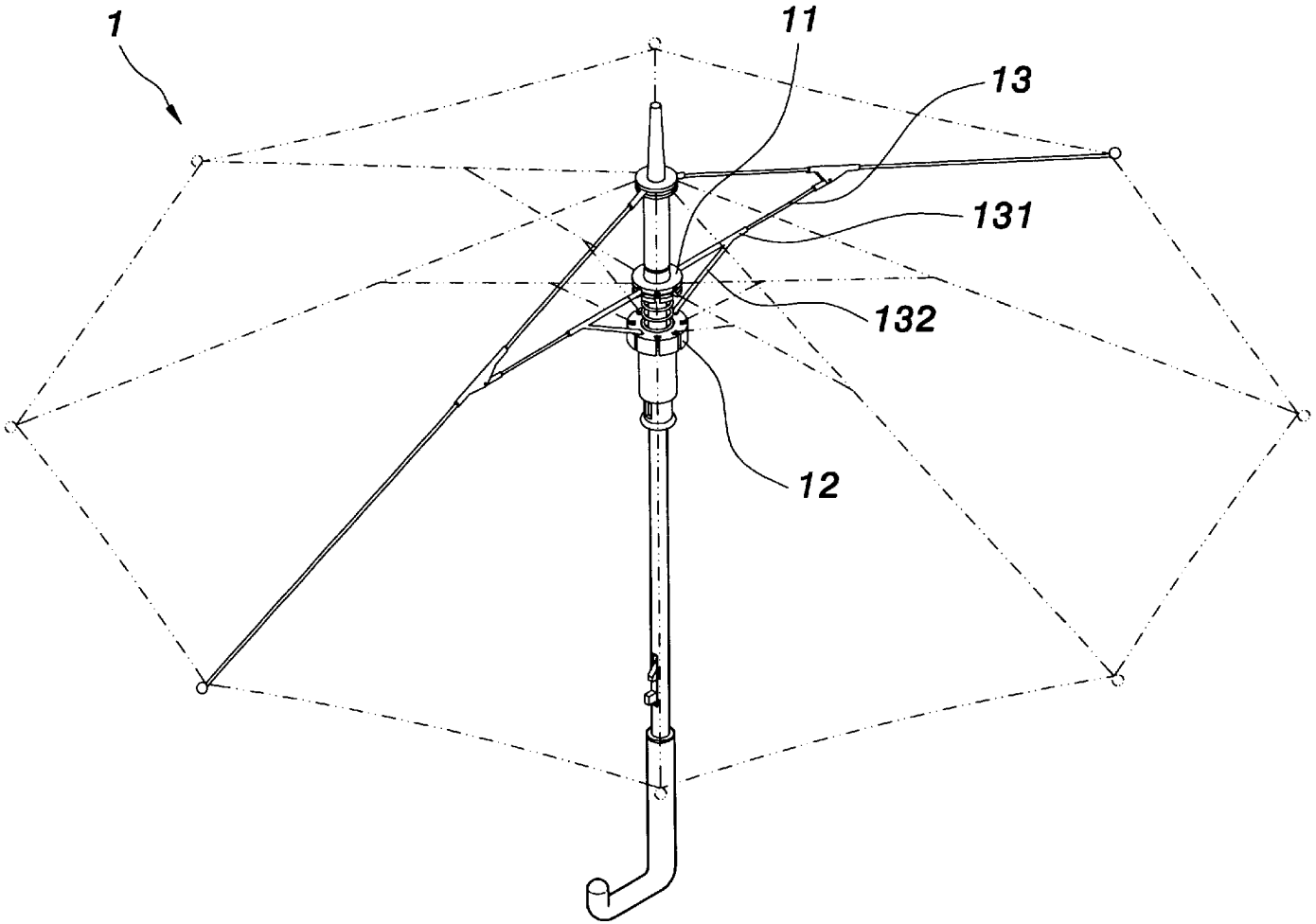
FIG. 2 shows an unfolded state of a self-opening umbrella of the present invention.
Figure 3:
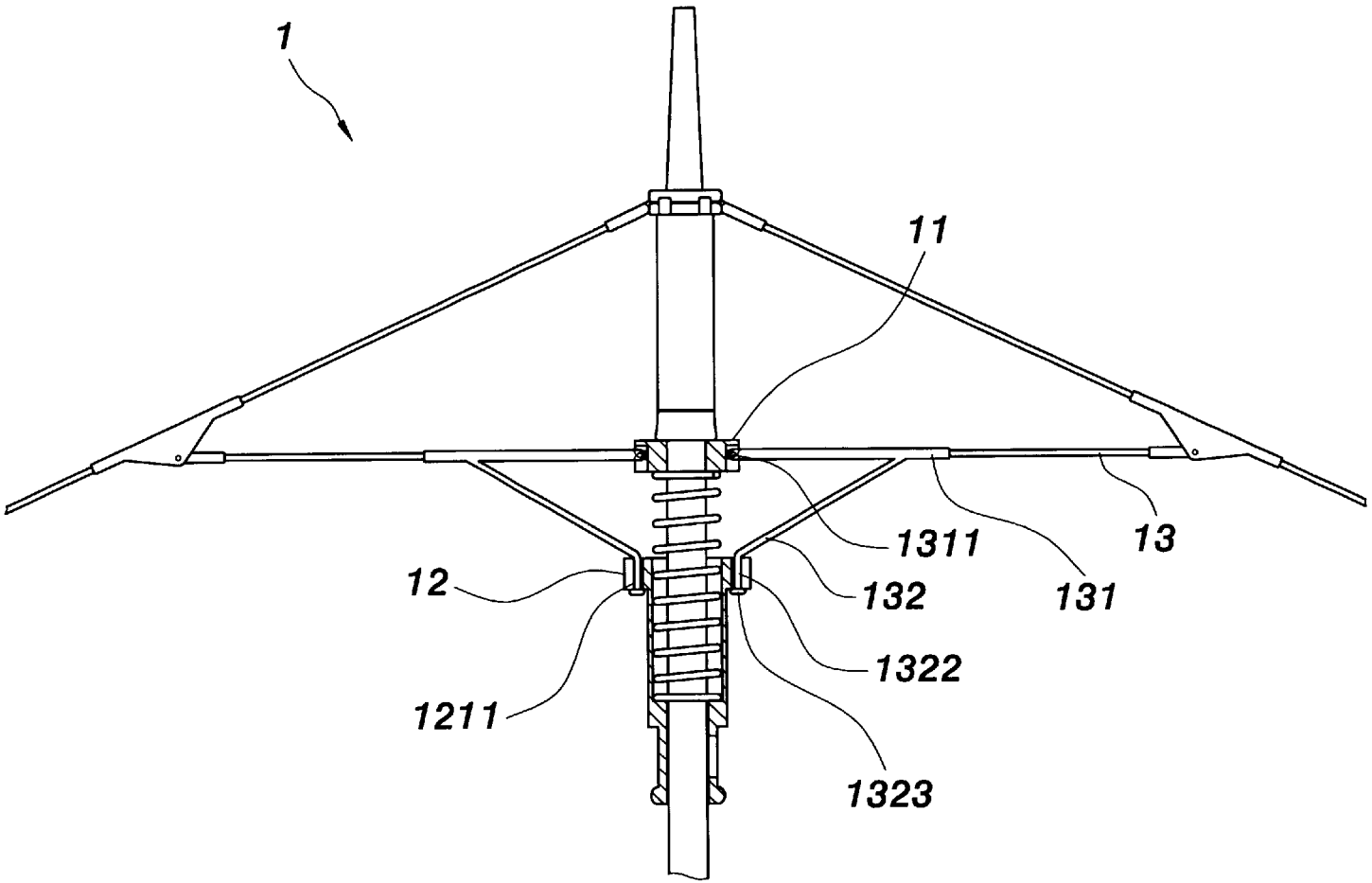
FIG. 3 is a diagram of a pull rod structure of the present invention.

As shown in FIGS. 2 and 3, the present invention provides an improved pull rod structure of a self-opening umbrella, wherein joints 131 are sleeved on stretchers 13 of a self-opening umbrella 1. The joints 131 are made of plastic material. The end of each of the joints 131 installed at a middle nest 11 has a first shuttle hole 1311 matched with the middle nest 11. A wire penetrates through the first shuttle holes 1311 and is then locked tightly in the middle nest 11. Each of the joints 131 also has a soft pull rod 132 integrally formed therewith. The other end of each of the soft pull rods 132 has an installation end installed in a lower nest 12.

Figure 4:
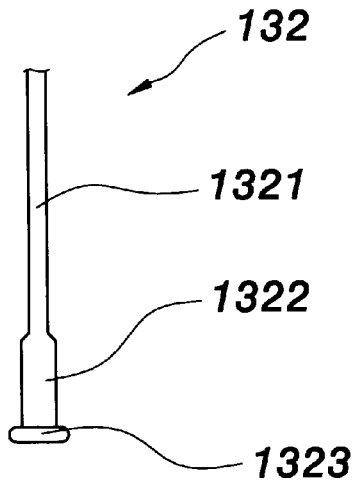
FIG. 4 is a side view of an installation end of a soft pull rod of the present invention.
Figure 5:
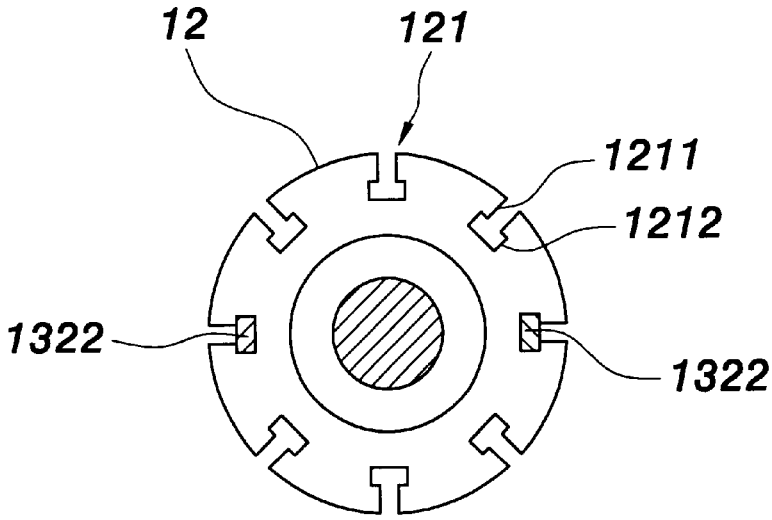
FIG. 5 is a diagram showing the joining of soft pull rods and a lower nest of the present invention.

As shown in FIGS. 3 to 5, the installation end of each of the soft pull rods 132 has a thin rod portion 1321, a locked-in section 1322, and an anti-escape head 1323. The thin rod portion 1321 is integrally formed with one of the joints 131. The lower end of the thin rod portion 1321 joins the locked-in section 1322 of a larger width. The bottom of the locked-in section 1322 joins the anti-escape head 1323. The anti-escape head 1323 is wider and flatter than the locked-in section 1322 to prevent the locked-in section 1322 from escaping from the lower nest 12. The lower nest 12 has positioning grooves 121 to install the soft pull rods 132. Each of the positioning grooves 131 has a narrow groove mouth 1211 and a wide groove bottom 1212. The width of the wide groove bottoms 1211 is matched with that of the locked-in sections 1322 of the soft pull rods 132 so that the locked-in sections 1322 can be exactly retained in the wide groove bottoms 1212. The narrow groove mouths 1211 have such an appropriate width that the locked-in sections 1322 cannot slide off the narrow groove mouths 1211 and the thin rod portions 1321 of the soft pull rods 132 can penetrate therethrough. When the soft pull rods 132 are to be installed in the lower nest 12, after the thin rod portions 1321 of the soft pull rods 132 first penetrate through the narrow groove mouths 1211 to reach the wide groove bottoms 1212, the soft pull rods 132 are pulled upwards so that the locked-in sections 1322 can be retained in the wide groove bottoms 1212. The anti-escape heads 1323 at the bottoms of the locked-in sections 1322 can let the locked-in sections 1322 not escape from the positioning grooves 121 of the lower nest 12 when the self-opening umbrella 1 is unfolded. If the self-opening umbrella 1 needs to be disassembled, it is only necessary to pull downwards the thin rod portions 1321 of the soft pull rods 132 to the wide groove bottoms 1212 of the lower nest 12 and then to remove the thin rod portions 1321 from the narrow groove mouths 1211, thereby letting the soft pull rods 132 be separated from the lower nest 12. In order to remove the joints 131 from the stretchers 13, it is only necessary to let the first shuttle holes 1311 be loosened from the soft pull rods 132, Very convenient replacement can thus be achieved.

Figure 6:
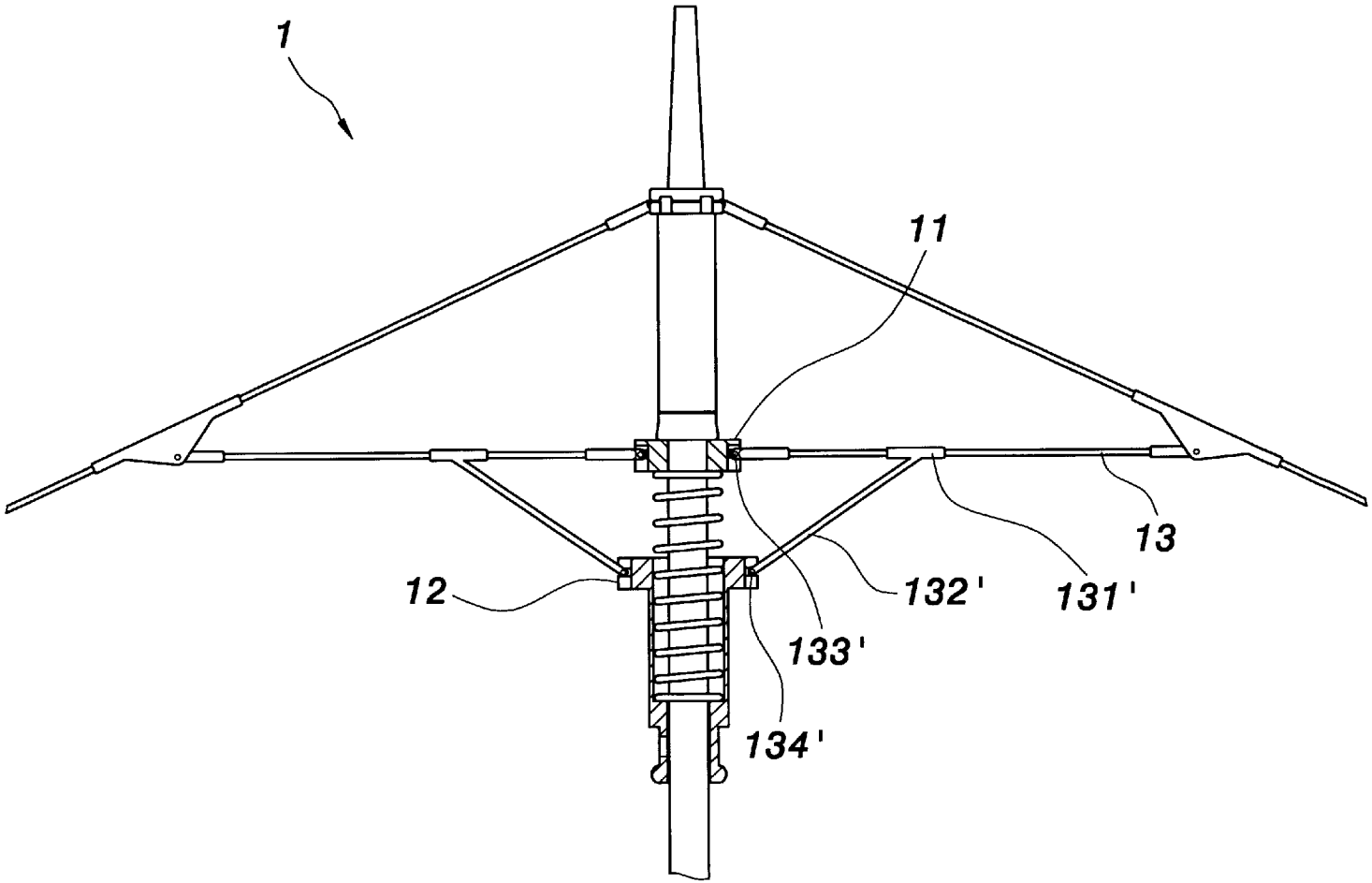
FIG. 6 is a diagram of another embodiment of the present invention.

FIG. 6 shows another embodiment of the present invention. In the self-opening umbrella 1, a short joint 131' is disposed on each of the stretchers 13 connected with the middle nest 11. The short joints 131' are made of plastic material. The short joints 131' are separated from second shuttle holes 133' of the stretchers 13. The second shuttle holes 133' are connected with the middle nest 11. Each of the short joints 131' has a soft pull rods 132' integrally formed therewith. The other end of each of the soft pull rods 132' has a third shuttle hole 134' connected with the lower nest 12. An improved pull rod structure of a self-opening umbrella of the present invention is thus formed.

To sum up, through an improved pull rod structure of a self-opening umbrella of the present invention, the assembly of a self-opening umbrella is very easy. Moreover, because the joints and the soft pull rods are made of plastic material, the manufacture will be very simple. Therefore, the manufacturing process of subassemblies can be simplified, and it is convenient to replace the subassemblies. Furthermore, because the soft pull rods can be bent many times, they can actually substitute for a complicated pull rod structure of a self-opening umbrella in the prior art.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An improved pull rod structure of a self-opening umbrella, each pull rod structure comprising:

a joint made of plastic material, said joint having a sleeve end for slidably receiving therein at least a portion of a radial stretcher; and a resilient pull rod integrally formed with said joint, said pull rod having a free end forming an installation end installed in a lower nest.

2. The improved pull rod structure of a self-opening umbrella as claimed in claim 1, wherein one end of said joint has a shuttle hole matched with a middle nest so that said joint can be directly installed in said middle nest.

3. The improved pull rod structure of a self-opening umbrella as claimed in claim 1, wherein said joint is separated from a shuttle hole of said stretcher installed in a middle nest.

4. The improved pull rod structure of a self-opening umbrella as claimed in claim 1, wherein said installation end of said resilient pull rod has a shuttle hole matched with said lower nest.

5. An improved pull rod structure of a self-opening umbrella comprising:

a joint made of plastic material and disposed on a stretcher; and a resilient pull rod integrally formed with said joint, the other end thereof being an installation end installed in a lower nest;

said installation end of said resilient pull rod including a thin rod portion integrally formed with said joint, a locked-in section matched with a positioning groove of said lower nest, and an anti-escape head, said locked-in section being disposed at a lower end of said thin rod portion and having a width larger than that of said thin rod portion;

said anti-escape head being disposed at a bottom of said locked-in section and having a width larger than that of said locked-in section to prevent said locked-in section from escaping off said positioning groove of said lower nest.

* * * * *